US010131137B2

(12) United States Patent
Henn et al.

(10) Patent No.: US 10,131,137 B2
(45) Date of Patent: Nov. 20, 2018

(54) SHEET-FED PRINTING PRESS WITH A SENSOR SYSTEM AND METHODS FOR CALIBRATING AND FOR ALIGNING THE SENSOR SYSTEM

(71) Applicant: HEIDELBERGER DRUCKMASCHINEN AG, Heidelberg (DE)

(72) Inventors: Andreas Henn, Neckargemuend (DE); Thomas Schmidt, Heidelberg (DE); Wolfgang Kabus, Schriesheim (DE); Stefan Knauf, Heidelberg (DE); Juergen Ritz, Dielheim (DE); Olaf Lorenz, Mutterstadt (DE); Christian Bull, Nussloch (DE); Stefan Muench, Heidelberg (DE); Thomas Goebel, Muehlhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 73 days.

(21) Appl. No.: 15/446,225

(22) Filed: Mar. 1, 2017

(65) Prior Publication Data

US 2017/0253022 A1 Sep. 7, 2017

(30) Foreign Application Priority Data

Mar. 3, 2016 (DE) ..... 10 2016 203 479

(51) Int. Cl.
*B41F 27/00* (2006.01)
*B41F 33/00* (2006.01)
*B41J 11/00* (2006.01)
*B41J 13/22* (2006.01)

(52) U.S. Cl.
CPC ..... *B41F 27/005* (2013.01); *B41F 33/0063* (2013.01); *B41J 11/0095* (2013.01); *B41J 13/223* (2013.01)

(58) Field of Classification Search
CPC .. B41J 11/0095; B41J 13/223; B41F 33/0063; B41F 27/005
See application file for complete search history.

(56) References Cited

U.S. PATENT DOCUMENTS 4,351,709 A * 9/1982 Goetz ..... G01N 27/44721 204/549
5,944,431 A 8/1999 Becker et al.
6,047,961 A 4/2000 Becker et al.
(Continued)

FOREIGN PATENT DOCUMENTS

DE 3328843 A1 6/1984
DE 19707657 A1 9/1998
(Continued)

*Primary Examiner* — David Banh
(74) *Attorney, Agent, or Firm* — Laurence A. Greenberg; Werner H. Sterner; Ralph E. Locher

(57) ABSTRACT

A sheet-fed printing press includes a printing cylinder and a high-precision sensor system for monitoring a sheet run in the area of the printing cylinder. At least one gage, which is mounted on the printing cylinder, can be detected by the sensor system. It is particularly advantageous if the sensor system is configured to be self-calibrating. A method for calibrating a sensor system and a method for aligning a sensor system are also provided.

10 Claims, 4 Drawing Sheets

(56) References Cited

U.S. PATENT DOCUMENTS

| | | | | |
|---|---|---|---|---|
| 6,144,038 | A * | 11/2000 | Gerstenberger | B65H 1/00 250/559.27 |
| 8,579,286 | B2 | 11/2013 | Hirai et al. | |
| 2009/0284561 | A1 | 11/2009 | Fukui | |
| 2013/0050377 | A1 | 2/2013 | Inoue | |
| 2013/0307893 | A1 | 11/2013 | Suda et al. | |

FOREIGN PATENT DOCUMENTS

| | | | |
|---|---|---|---|
| DE | 19707660 | A1 | 9/1998 |
| EP | 1261877 | B1 | 2/2010 |
| EP | 2422989 | A2 | 2/2012 |
| EP | 2562107 | B1 | 9/2014 |
| JP | 2012166347 | A | 9/2012 |

* cited by examiner

SHEET-FED PRINTING PRESS WITH A SENSOR SYSTEM AND METHODS FOR CALIBRATING AND FOR ALIGNING THE SENSOR SYSTEM

CROSS-REFERENCE TO RELATED APPLICATION

This application claims the priority, under 35 U.S.C. § 119, of German Patent Application DE 10 2016 203 479.0, filed Mar. 3, 2016; the prior application is herewith incorporated by reference in its entirety.

BACKGROUND OF THE INVENTION

Field of the Invention:

The invention relates to a sheet-fed printing press including a printing cylinder and a sensor system for monitoring a sheet run in the area of the printing cylinder. The sensor system is disposed in the sheet run area and has a transmitter and a receiver. The transmitter is disposed on one end face and the receiver is disposed on the other end face of the printing cylinder in such a manner that a viewing direction of the sensor system is at right angles to a transport direction of the sheet. The invention also relates to a method for calibrating a sensor system for monitoring the sheet run in the area of the printing cylinder of a sheet-fed printing press and a method for aligning a sensor system for monitoring the sheet run of sheets of different thickness in the area of the printing cylinder of a sheet-fed printing press.

Description of the Related Art:

The use of digital printing presses is known for the printing of sheets of paper, card, or board in small runs or with individual print motifs. When using inkjet heads for printing sheets, a respective sheet is moved through under the inkjet heads by a transport system at a minimal distance. Circulating conveyor belts, for example, constructed as suction belts, and rotating cylinders, so-called jetting cylinders, or circulating tablets as described, for example, in U.S. Pat. No. 8,579,286 B2 are known as transport systems.

In machine concepts using cylinders, as described for example, in U.S. Patent Application Publication US 2009/0284561 A1, a plurality of inkjet heads are disposed radially at a distance above a jetting cylinder. The inkjet heads print sheets moved past the printing heads at a short distance. A plurality of sheets can be sucked onto a jetting cylinder and transported simultaneously. In order to ensure a high print quality and avoid damage to the printing heads, it is important that a respective sheet lies correctly on the jetting cylinder.

In addition, it is known to monitor the sheet run and detect defective sheets or incorrectly placed sheets. In order to prevent damage to the highly sensitive printing nozzles of an inkjet head, for example due to high-standing corners, edges, or folds, the printing press is usually stopped and the defective sheet is removed.

Such a printing press is described in U.S. Patent Application Publication US 2013/0307893 A1. If a defective sheet is detected by a sensor mounted upstream of the inkjet heads, not only is the machine stopped but all of the inkjet heads are raised and thus brought into a withdrawal position. The defective sheets can then be removed easily by the machine operator.

Various sensor systems for monitoring sheets in printing presses are known in the prior art. For example, a light curtain which is described in German Patent Application DE 197 07 660 A1, corresponding to U.S. Pat. No. 5,944,431, is disposed below a reversing drum of a sheet-fed printing press for monitoring the sheet-reversal area. Transmitters and receivers of that sensor system are disposed on the drive and operating sides, on both sides of the reversing drum.

A sensor for monitoring the sheet run in a digital printing press is known from European Patent EP 2 562 107 B1, corresponding to U.S. Patent Application Publication US 2013/0050377.

On one hand, inaccuracies of the sensor systems can have the result that defective sheets are not detected. On the other hand, good sheets can be incorrectly detected as defective sheets.

SUMMARY OF THE INVENTION

It is accordingly an object of the invention to provide a sheet-fed printing press with a sensor system and methods for calibrating and for aligning the sensor system, which overcome the hereinafore-mentioned disadvantages of the heretofore-known devices and methods of this general type and which provide a higher-precision sensor system to be used in the methods for calibrating and for aligning the sensor system.

With the foregoing and other objects in view there is provided, in accordance with the invention, a sheet-fed printing press including a machine controller and a sensor system, wherein the sensor system includes a light curtain having a multiplicity of laser beams for monitoring the sheet run in the area of the printing cylinder. As a result of using a light curtain instead of a single light beam, the sheet run of sheets of different thickness can be monitored. The sensor system is disposed in the sheet run area and has at least one transmitter and at least one receiver. The transmitter is disposed on one side and the receiver is disposed on the other side of the printing cylinder, that is the viewing direction of the sensor system is substantially at right angles to a transport direction of the sheets. In other words, the transmitter and the receiver are disposed on the front side of the printing cylinder, on the drive side and on the operating side. According to the invention, at least one gage which is co-rotating with the printing cylinder is attached to the printing cylinder and can be detected by the sensor system. It is particularly advantageous if the sensor system is configured to be self-calibrating.

In such a sheet-fed printing press, an autocalibration of the sensor system, that is a fully automatic calibration of the sensor system, which is also known as a calibration, is possible. Through the use of the gages and a continuous recalibration of the sensor system, drift effects, for example as a result of thermal expansions of the side walls of the sheet-fed printing press or holders of the sensor system can be compensated. Consequently, the error rate of the sensor system is significantly reduced and only actually defective sheets are reliably detected.

In an advantageous further development of the sheet-fed printing press according to the invention, the gage images different sheet thicknesses over the angle of rotation of the printing cylinder, that is a certain sheet thickness measured value of the gage is assigned to a certain machine angle and therefore a certain angle of rotation of the printing cylinder. Thus, a certain sheet thickness measured value h is assigned due to the curved or stepped upper edge of the gage to a certain angle of rotation $\varphi$.

Advantageously the gage or the gages can be mounted in one or each channel of the printing cylinder or next to the channel. The placement of the gages in one channel of the printing cylinder is preferred since a collision-free circulation of the printing cylinder can thus be guaranteed in the simplest manner.

It is further deemed to be advantageous if at least two gages are provided, wherein at least one gage is disposed on one side and at least another gage is disposed on the other side of the printing cylinder. In other words, one of the gages tends to be disposed on the drive side and the other gage tends to be disposed on the operating side.

In a further development, the at least two gages are disposed offset with respect to one another in the channels of the printing cylinder, that is the gages are mounted with an angular offset with respect to one another. This enables both gages to measure with the sensor system and thus enables an axially parallel alignment of the sensor system to the printing cylinder.

With the objects of the invention in view, there is also provided a method for calibrating a sensor system for monitoring the sheet run in the area of the printing cylinder of a sheet-fed printing press, wherein at least one gage is detected by the sensor system during rotation of the printing cylinder, in particular during each revolution and the measurement result is compared with a desired value stored in a sensor controller, and if necessary a correction of the sensor system is made.

In a preferred embodiment of the method, in the sensor controller a certain desired value is assigned to a specific angle of rotation of the printing cylinder with its gage. In this way, deviations and error trends of the sensor system can be detected.

As an advantageous embodiment of the method, in the event of a deviation of the measured value from the desired value, i.e. if the measurement result of the calibrating measurement of the gage differs from a desired value stored in the sensor controller, the measured value is stored as a new threshold value for monitoring the sheet run in the sensor controller. This is used to compensate for mechanical and electrical drift, for example, as a result of thermal expansions of the cylinder or the sensor system.

In other words, in the method the height value of the gage is always measured at a specific angle of rotation of the printing cylinder with its gage, for example, at an angle of rotation φ0.6, which corresponds to a desired printing substrate thickness monitoring of, for example, 0.6 mm. That is, sheets having a greater thickness, e.g. as a result of a sheet error (sheet laying error, dog's ears, fold . . . ) should be detected by the sensor system. The measured value determined by the sensor system at the gage is then used for monitoring the printing substrate thickness, as a so-called threshold value. To this end, the threshold value is stored in the sensor controller. If a measured value of a measured printing substrate thickness lies above the stored threshold value, that sheet is considered to be a defective sheet. During each run through the gage, the gage is measured anew by the sensor system and the measured value thus obtained is stored as new threshold value in the sensor controller and used for monitoring the sheets.

With the objects of the invention in view, there is additionally provided a method for aligning a sensor system for monitoring the sheet run in the area of the printing cylinder of a sheet-fed printing press, including a sensor system which has a transmitter and a receiver, the transmitter is disposed on one side and the receiver is disposed on the other side of the printing cylinder, at least two gages are provided and at least one of the gages is disposed on one side and at least another of the gages is disposed on the other side of the printing cylinder. According to the invention, the sensor system is adjusted independently on the transmitter side and on the receiver side depending on the measurement result of the measurement of the gages and a parallel position of the sensor system to the lateral surface of the printing cylinder is thus achieved.

With the objects of the invention in view, there is concomitantly provided a method for aligning a sensor system for monitoring the sheet run in the area of the printing cylinder of a sheet-fed printing press, including at least two gages being attached to the printing cylinder and detected by the sensor system. The measurement results are compared with desired values stored in a sensor controller, and in the event of a deviation the sensors (transmitter and receiver) of the sensor system are shifted and thereby adjusted. In other words, in order to adjust the sensor system and set the correct distance of the sensor system from the printing cylinder, for example, for monitoring a certain sheet thickness of, for example, 0.6 mm, it is considered at which angle of rotation the sensor system is damped. In this example, it must be damped at an angle φ0.6 mm. If, however, it is damped at an angle φ0.3 mm, the sensor system must be shifted by a further distance of 0.3 mm.

The aforesaid methods for aligning can be used both during commissioning and also during running of the sheet-fed printing press.

When manufacturing the gages, deviations caused by manufacturing tolerances can occur, which would very adversely affect the measurement result of the sensor system. Thus, the deviations of the two gages can be measured beforehand and be taken into account subsequently. The deviations during alignment of the sensor system are thus taken into account so that they are nevertheless aligned parallel to the printing cylinder. The deviations are also taken into account during running and during calibrating in order to be able to measure with a higher accuracy. To this end, the deviations are stored in the sensor controller.

Other features which are considered as characteristic for the invention are set forth in the appended claims.

Although the invention is illustrated and described herein as embodied in a sheet-fed printing press with a sensor system and methods for calibrating and for aligning the sensor system, it is nevertheless not intended to be limited to the details shown, since various modifications and structural changes may be made therein without departing from the spirit of the invention and within the scope and range of equivalents of the claims. The described invention and the described advantageous further developments of the invention also form advantageous further developments of the invention combined with one another, if this is technically appropriate.

The construction and method of operation of the invention, however, together with additional objects and advantages thereof will be best understood from the following description of specific embodiments when read in connection with the accompanying drawings.

DETAILED DESCRIPTION OF THE INVENTION

Figure 4:
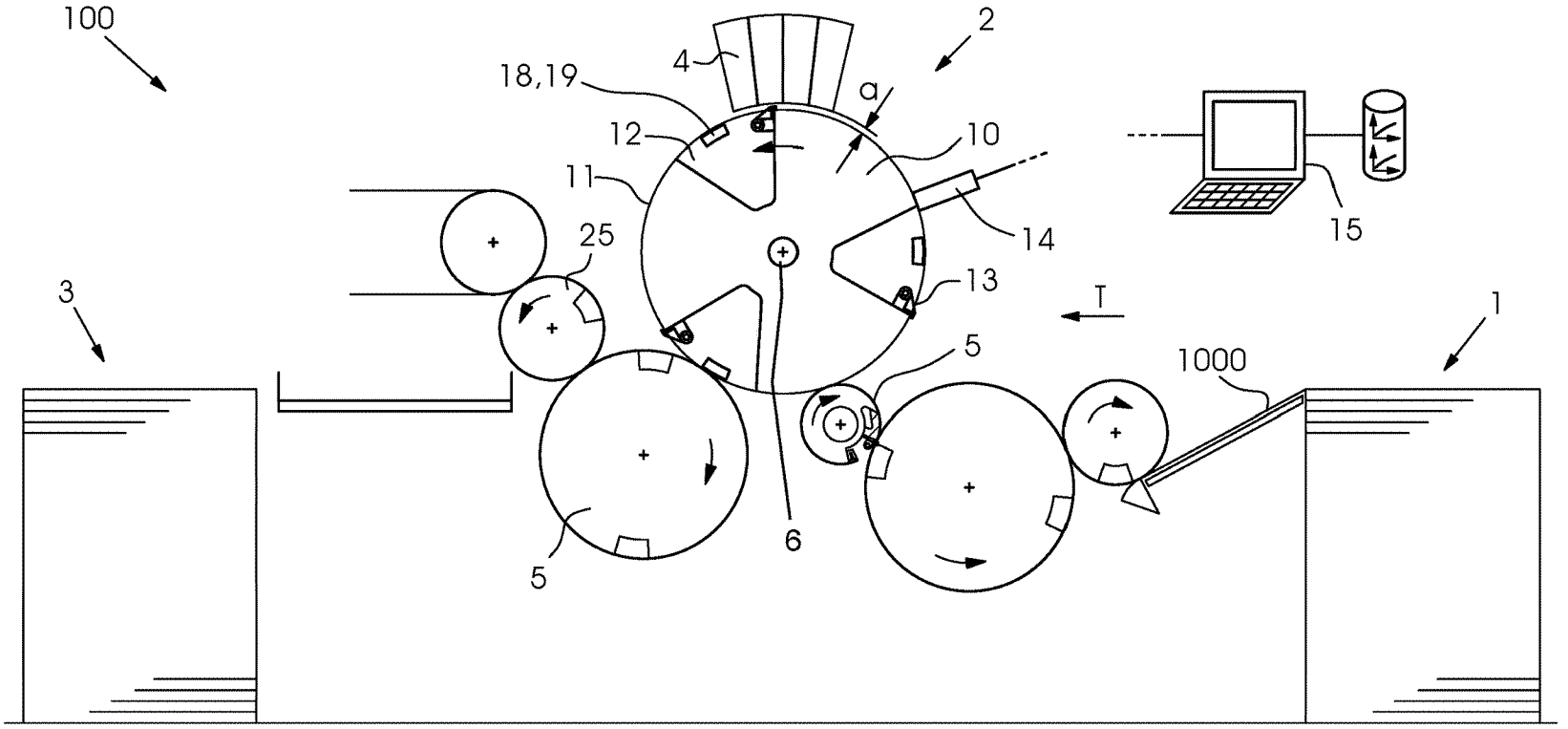
FIG. 4 is a longitudinal-sectional view showing a digital sheet-fed printing press with a sensor system for monitoring a sheet run.

Referring now to the figures of the drawings in detail and first, particularly, to FIG. 4 thereof, there is seen a sheet-fed printing press 100, which is constructed as a digital printing press. A respective sheet 1000 is transported from a feeder 1 in a transport direction T through a printing mechanism 2 to a delivery 3. The transport of a respective sheet 1000 is in this case primarily accomplished by using cylinders, namely transfer cylinders 5 and a printing cylinder 10. Located above the printing cylinder 10 at a distance a from the printing cylinder 10 are inkjet heads 4, which print a sheet 1000 passing by the printing cylinder 10 at a short distance. The printing cylinder 10 is therefore also designated as a jetting cylinder. A drive 6 is provided for the printing mechanism 2.

In the embodiment shown, the printing cylinder 10 has three sheet retaining regions 11, which are each separated from one another by a respective channel 12. The sheets 1000 are held on the sheet retaining regions 11 by using grippers 13. Gages 18, 19 are provided in the channels 12.

A machine controller 15 with an operator interface and a memory is provided for driving the printing press 100. Located upstream of the inkjet heads 4 when viewed in the transport direction T is a sensor system 14, which is used for permanent monitoring of the sheets 1000 and the gages 18, 19. To this end, the sensor system 14 is disposed in the sheet run. The sheet run, in particular the printing substrate thickness d, can be monitored, i.e. how far the sheets 1000 project beyond the sheet retaining regions 11. Kinks, dog's ears, folded, corrugated, incompletely or poorly retained sheets 1000 can thus be identified. The sensor system 14 is connected in a data transmitting manner to the machine controller 15, which also includes a sensor controller.

The sensor system 14 must be disposed sufficiently upstream of the inkjet heads 4 so that even if there is a defect on the rear sheet edge, a collision of sheets 1000 and inkjet heads 4 can still be avoided, e.g. by stopping the machine 100, raising the inkjet heads 4 or discharging the defective sheet 1000 (not shown).

Located downstream of the jetting cylinder 10 is a discharge drum 25, through the use of which defective sheets, i.e. incompletely printed sheets 1000, can be discharged.

Figure 1A:
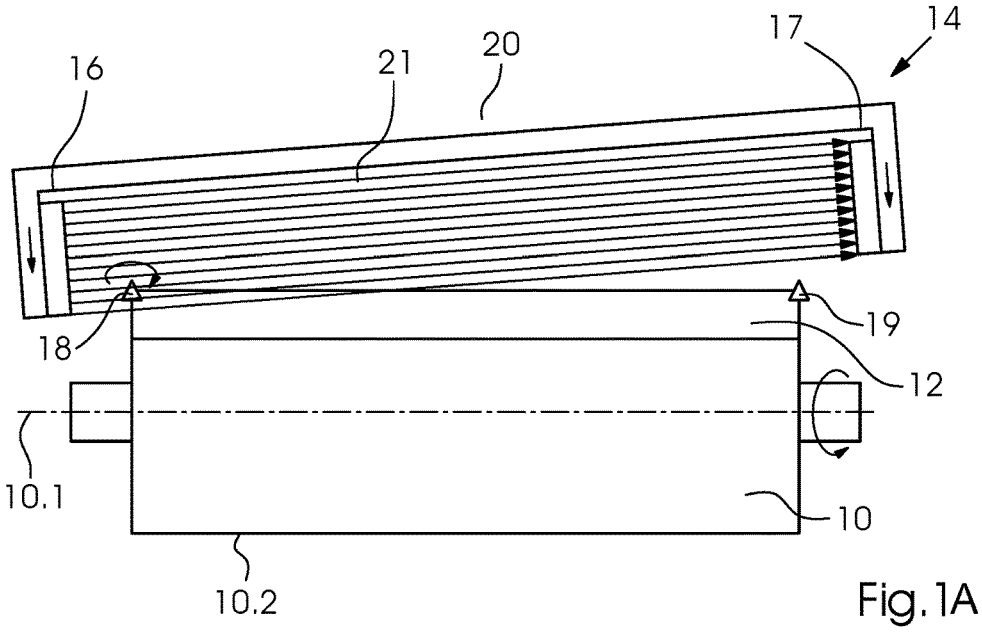
FIGS. 1A and 1B are diagrammatic, front-elevational views illustrating a process for aligning a sensor system.
Figure 1B:
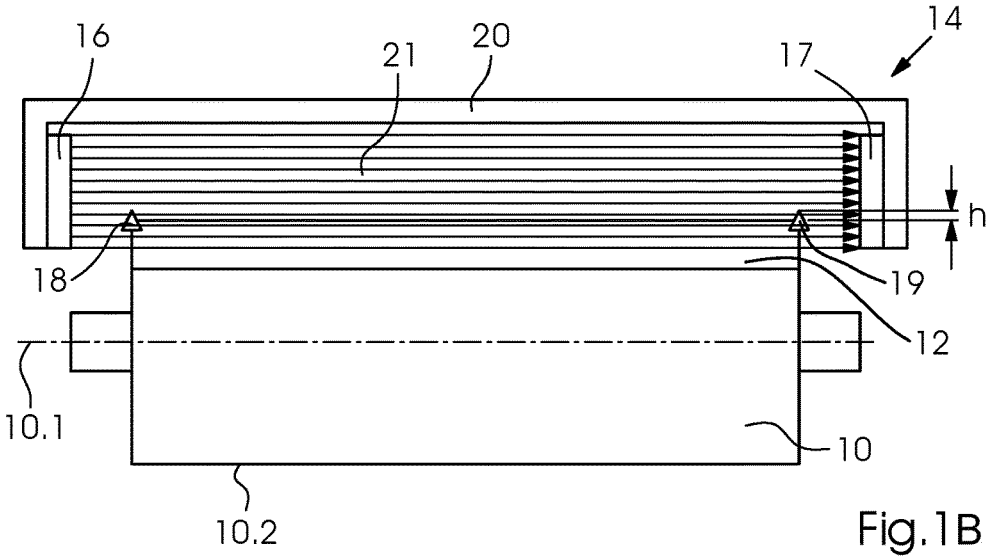
Figure 1C:
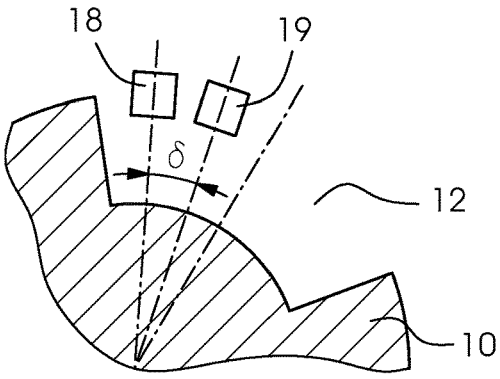
FIG. 1C is a fragmentary, cross-sectional view showing gages for the alignment.

The method for aligning a sensor system 14 can be understood from FIGS. 1A and 1B. The sensor system 14 includes a light curtain 21 having a multiplicity of laser beams for monitoring the sheet run in the area of the printing cylinder 10. As a result of using a light curtain instead of a single light beam, the sheet run of sheets of different thickness can be monitored. The sensor system 14 also has a transmitter 16 and a receiver 17. The transmitter 16 is positioned on one side of the printing cylinder 10 and the receiver 17 is positioned on the other side of the printing cylinder 10. The transmitter and the receiver can be accommodated by a retaining clip 20. The retaining clip 20 of the sensor system 14 is accommodated by a machine frame of the printing press 100 which is not shown in detail and can be adjusted relative to the machine frame. The gages 18, 19 are provided in the channel 12 of the printing cylinder 10. The gage 18 is positioned on the drive-side end of the channel 12 and the gage 19 is positioned on the operator-side end of the channel 12. As can be seen clearly from the highly-exaggerated view of FIG. 1A, the sensor system 14 is not aligned parallel to the axis 10.1 and to the lateral surface 10.2 of the printing cylinder 10. An alignment of the sensor system 14 can now be made by lowering the sensor system 14 more severely on the operator side than on the drive side. That is, the sensor system 14 is lowered until the same value is measured on the two gages 18, 19. To this end, the gages 18, 19 are disposed with an angular offset θ with respect to one another, as shown in FIG. 1C. The result of this alignment method is shown in FIG. 1B. The sensor system 14 is now aligned parallel to the lateral surface and to the axis of the printing cylinder 10.

If two gages 18, 19 are provided, an increasing inclination of the sensor system 14 during operation can be identified and this can be corrected by the machine controller 15 or at least displayed to the machine operator.

Figure 3:
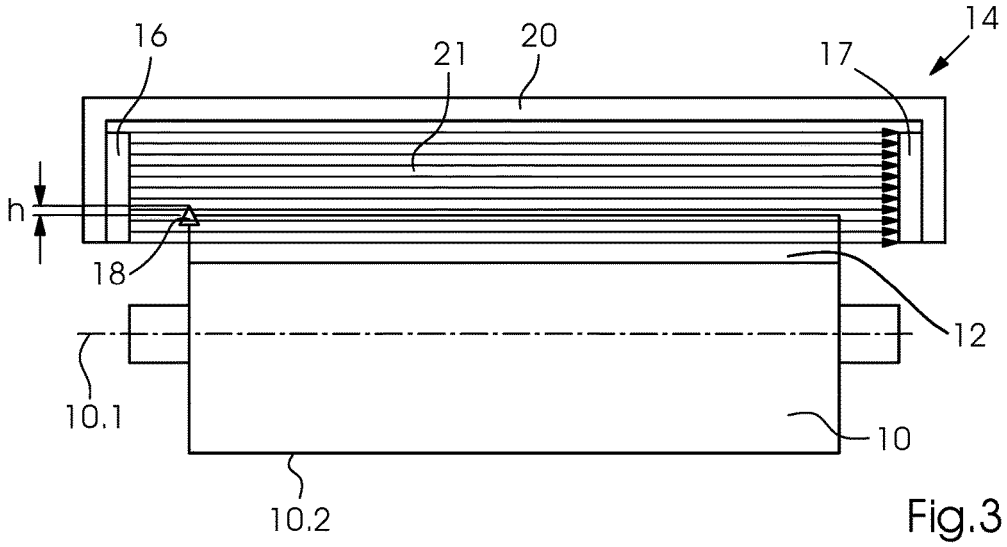
FIG. 3 shows the sensor system with only one gage.

If only one gage 18 is provided, as is seen in FIG. 3, an inclination cannot be detected.

A further alignment of the sensor system 14 can be necessary if the distance of the sensor system 14 from the lateral surface of the printing cylinder 10 is not correct. Then no correct monitoring of the sheet run can be made by the sensor system 14. In order to carry out an alignment of the sensor system 14 in this case, the distance of the sensor system 14 from the printing cylinder 10 is corrected until the measured values of the sensor system 14 recorded for at least one gage 18, 19 correspond to the desired values stored in a controller 15.

Figure 2A:
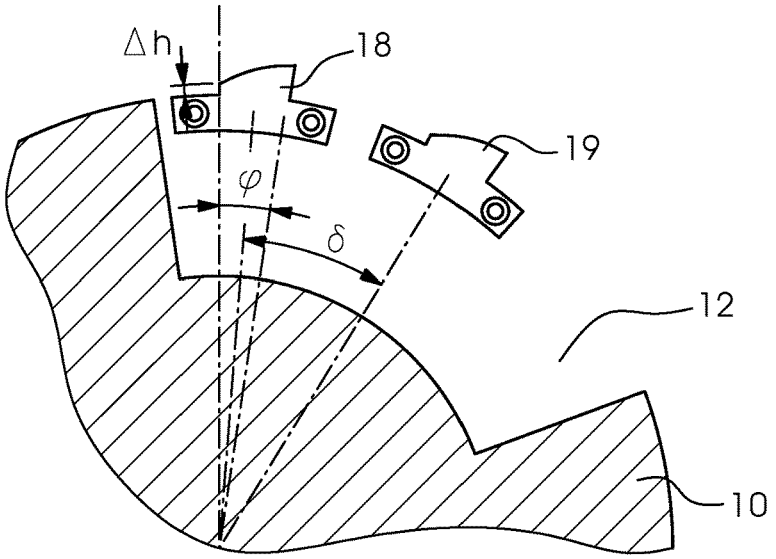
FIG. 2A is a fragmentary, cross-sectional view showing the use of gages for a permanent calibration of the sensor system.
Figure 2B:
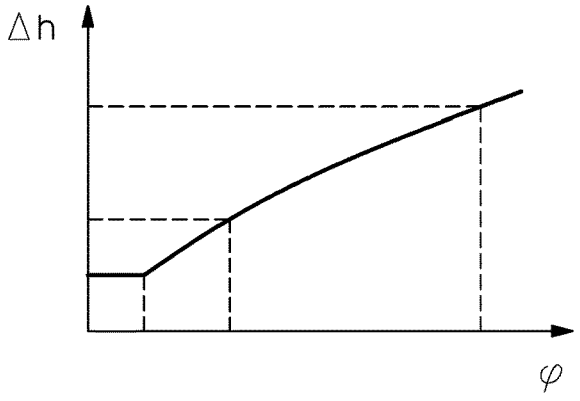
FIGS. 2B and 2C are diagrams showing continuous and discontinuous curves of a sheet thickness plotted against an angle of rotation.
Figure 2C:
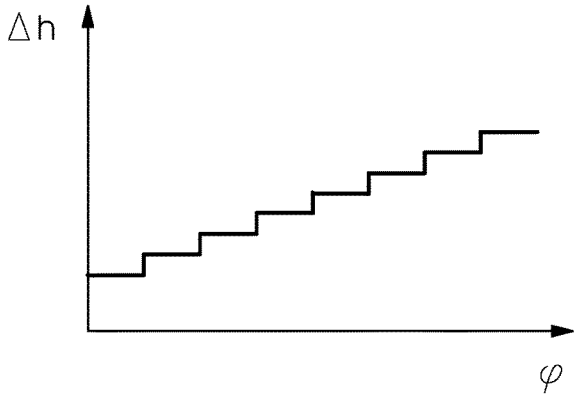

The structure of the sheet-fed printing press in the area of the gages and the method for calibrating the sensor system 14 can be seen from FIGS. 2A to 2C. The gages 18, 19 are mounted in a channel 12 of the printing cylinder 10 and connected thereto. Gages 18, 19 can also be provided in each channel 12 of the printing cylinder 10. In this case, one gage 18 is disposed at one end of the channel 12 and the other gage 19 is disposed at the other end of the channel 12, that is, one gage 18 is positioned on the drive side and one gage 19 is positioned on the operating side. In addition, the gages 18, 19 are disposed offset with respect to one another in the channel with an angular offset θ. The upper edge of a respective gage 18, 19 thereby forms a curve. Through the use of this curve a certain sheet height h is assigned to a specific machine angle or angle of rotation cp. As can be seen from the diagram of FIG. 2B, for example, by using the curve of the gage 18, 19 a sheet thickness h 0.3 mm is assigned to an angle of rotation φ0.3 mm and a sheet thickness h 0.6 mm is assigned to an angle of rotation φ0.6 mm. Each angle of rotation φ is in turn assigned a desired value in the controller 15 which is used as a threshold value for monitoring the sheet run. If a measured value different from the desired value is obtained in the measurement of the gages 18, 19 during rotation of the printing cylinder 10, the new measured value is stored as a threshold value in the controller 15 whereby a calibration of the sensor system 14 is accomplished.

The curve of the gages 18, 19 can alternatively also be discontinuous and composed of steps, as shown in FIG. 2C.

Advantageously common gages 18, 19 can be provided for aligning and calibrating. The gages 18, 19 can have partial surfaces for this purpose which are recorded by the sensor system 14 during the aligning or calibrating.

The invention claimed is:

1. A sheet-fed printing press, comprising:

a sheet run area for guiding a sheet run in a sheet transport direction;

a printing cylinder having two end faces;

at least one gage being mounted on said printing cylinder; and a sensor system for monitoring the sheet run in a vicinity of said printing cylinder and for detecting said at least one gage, said sensor system being disposed in said sheet run area, said sensor system including a light curtain having a multiplicity of laser beams, and said sensor system including a transmitter and a receiver;

said transmitter being disposed at one of said end faces and said receiver being disposed at another of said end faces of said printing cylinder defining a viewing direction of said sensor system at right angles to said sheet transport direction.

2. The sheet-fed printing press according to claim 1, wherein said sensor system is self-calibrating.

3. The sheet-fed printing press according to claim 1, wherein said at least one gage images different sheet heights over an angle of rotation.

4. The sheet-fed printing press according to claim 1, wherein said printing cylinder includes a channel, and said at least one gage is mounted in said channel or next to said channel.

5. The sheet-fed printing press according to claim 1, wherein said printing cylinder has two sides, said at least one gage includes at least two gages, at least one of said gages is disposed on one side and at least one other of said gages is disposed on the other side of said printing cylinder.

6. The sheet-fed printing press according to claim 5, wherein said at least two gages are disposed with a mutual angular offset on said printing cylinder.

7. A method for calibration of a sensor system for monitoring a sheet run in a vicinity of a printing cylinder of a sheet-fed printing press, the method comprising the following steps:

attaching at least one gage to the printing cylinder;

using the sensor system to detect the at least one gage during rotation of the printing cylinder and to provide a measurement result;

storing a desired value in a sensor controller and assigning a certain desired value as a measured value to a specific angle of rotation in the sensor controller;

comparing the measurement result with the stored desired value; and if necessary, performing a correction of the sensor system for the calibration by storing the measured value as a threshold value for monitoring the sheet run in the sensor controller upon a deviation of the measured value from the desired value.

8. The method for calibrating according to claim 7, which further comprises taking manufacturing tolerances of the at least one gage into account in the calibrating and using the manufacturing tolerances for codetermining the desired value.

9. A method for aligning a sensor system for monitoring a sheet run of sheets of different thickness in a vicinity of a printing cylinder of a sheet-fed printing press, the method comprising the following steps:

providing a printing cylinder having two sides;

attaching at least one gage supplying measured values on one of the sides and attaching at least one other gage supplying measured values on another of the sides of the printing cylinder;

using the sensor system to detect the at least two gages;

providing the sensor system with a transmitter, a receiver and a light curtain with a multiplicity of laser beams;

placing the transmitter on one side and placing the receiver on the other side of the printing cylinder;

adjusting the sensor system independently on the one side of the printing cylinder having the transmitter and on the other side of the printing cylinder having the receiver for a parallel position of the sensor system;

storing a threshold value in a machine controller; and comparing the measured values of the gages and making a correction of the position of the transmitter and the receiver or displaying a warning, upon exceeding the threshold value stored in the machine controller.

10. The method for aligning according to claim 9, which further comprises taking manufacturing tolerances of the gages into account when aligning for aligning the sensor system parallel to the printing cylinder.

* * * * *